US008473166B2

(12) United States Patent
Zhdanov et al.

(10) Patent No.: US 8,473,166 B2
(45) Date of Patent: Jun. 25, 2013

(54) SEMIAUTOMATIC CONTROL OF EARTHMOVING MACHINE BASED ON ATTITUDE MEASUREMENT

(75) Inventors: Alexey Zhdanov, Moscow (RU); Atsushi Tanahashi, Foster City, CA (US); Vernon Joseph Brabec, Livermore, CA (US)

(73) Assignee: Topcon Positioning Systems, Inc., Livermore, CA (US)

( * ) Notice: Subject to any disclaimer, the term of this patent is extended or adjusted under 35 U.S.C. 154(b) by 311 days.

(21) Appl. No.: 12/757,302

(22) Filed: Apr. 9, 2010

(65) Prior Publication Data

US 2010/0299031 A1 Nov. 25, 2010

Related U.S. Application Data

(60) Provisional application No. 61/179,414, filed on May 19, 2009.

(51) Int. Cl.
*G06F 7/00* (2006.01)

(52) U.S. Cl.
USPC ..... 701/50

(58) Field of Classification Search
USPC ..... 701/50
See application file for complete search history.

(56) References Cited

U.S. PATENT DOCUMENTS 4,157,118 A * 6/1979 Suganami et al. ..... 172/4.5
4,561,188 A 12/1985 Williams et al.
5,860,480 A * 1/1999 Jayaraman et al. ..... 172/2
5,917,593 A 6/1999 Hirano et al.
7,121,355 B2 10/2006 Lumpkins et al.
7,317,977 B2 1/2008 Matrosov
2009/0069987 A1 * 3/2009 Omelchenko et al. ..... 701/50

FOREIGN PATENT DOCUMENTS

EP 09156186 3/2009

OTHER PUBLICATIONS

PCT International Search Report corresponding to PCT Application PCT/IB2010/000902 filed Apr. 21, 2010 (4 pages).
PCT Written Opinion of the International Searching Authority corresponding to PCT Application PCT/IB20101000902 (9 pages).

* cited by examiner

*Primary Examiner* — Thomas Tarcza
*Assistant Examiner* — Maceeh Anwari
(74) *Attorney, Agent, or Firm* — Wolff & Samson, PC

(57) ABSTRACT

The blade on an earthmoving machine is controlled by a semiautomatic method comprising a combination of a manual operational mode and an automatic operational mode. An operator first enters the manual operational mode and manually sets the height of the blade. The operator then enters the automatic mode and sets a reference pitch angle and an initial control point. The height of the blade is automatically controlled based on pitch angle measurements received from pitch angle sensors. Automatic control is effective over a particular range of soil conditions. When the automatic control range is exceeded, the operator manually shifts the control point, and automatic control resumes about the new control point. Blade slope is automatically controlled based on roll angle measurements received from roll angle sensors.

20 Claims, 16 Drawing Sheets

SEMIAUTOMATIC CONTROL OF EARTHMOVING MACHINE BASED ON ATTITUDE MEASUREMENT

This application claims the benefit of U.S. Provisional Application No. 61/179,414 filed May 19, 2009 which is incorporated herein by reference.

BACKGROUND OF THE INVENTION

The present invention relates generally to earth moving equipment, and more particularly to semiautomatic control of earthmoving machines based on attitude measurement.

Various construction equipment is used for performing construction projects, such as airports and roads. These projects typically involve preparation of land according to architectural and engineering specifications. Earthmoving machines, such as bulldozers and graders, are used to prepare the site. Skilled operators can control these machines to perform high-quality grading operations to prepare the site for final use or to prepare the site for further work (such as adding road ballast, pouring concrete, or paving with asphalt). In a construction project, surveyors typically do an initial layout of a jobsite (for example, set the desired boundaries and height levels) and perform additional layouts as the construction works proceed. A layout is typically setup with visual markers, such as stakes and poles, which may be viewed by a machine operator. This procedure is very time-consuming, especially when high accuracy of the terrain (ground) profile is required. Multiple iterations of setting up a layout and checking the terrain profile are often required.

To attain a precise terrain profile, the machine operator needs to be highly qualified and experienced. Not only does he need to adjust the implement (such as a blade) position according to the height assigned by the markers, but he must also compensate for parasitic effects, such as perturbation factors from the underlying terrain and blade load on the machine body, that tend to arbitrarily change the spatial position of the blade. Furthermore, simultaneous dual-channel adjustment of blade position with respect to height (elevation) and degree of inclination (slope) is a difficult operation. Weather conditions may also adversely impact attainment of the required terrain profile, since limited visibility often prevents the operator from observing the markers.

To assist the operator in attaining the required terrain profile, different types of grading control systems may be installed on the machines. These grading control systems use sensor measurements to position the implement according to the assigned terrain profile. The sensors are mounted onto the machine itself and do not require visual observations of the blade position relative to any markers. Grading control systems may be divided into two major categories: indicator and automatic. The indicator systems provide the operator with visual mismatch indicators representing the error between the actual and desired positions of the implement, according to a set of user-defined coordinates. The operator visually observes the indicators in the machine cab and makes appropriate adjustments by manually activating a control lever which controls the blade hydraulic cylinders. The automatic systems may directly control the blade hydraulic cylinders based on error signals. Electronically controlled valves are used in such systems. Automatic systems are more expensive than indicator ones since additional components are needed for automatic hydraulic control.

Different indicator systems accommodate different degrees of freedom in the implement positioning system. To unambiguously determine the position and orientation of a ground-based object (such as an implement on an earthmoving machine), three position coordinates (for instance, geographic latitude, longitude, and height) and three attitude angles (for example, pitch, roll, and heading) are needed; that is, six degrees of freedom. Some applications, however, may use systems with fewer than six degrees of freedom.

A system with one angular degree of freedom may be used for estimating a blade roll or machine body roll angle with respect to the horizon. It can be based on liquid or Micro-Electro-Mechanical Systems (MEMS) accelerometer sensors sensitive to the Earth's gravitational field. To measure roll angle, the sensitive axis of the sensor is placed along the lateral direction. Such sensors are called inertial because they operate within an inertial coordinate frame obeying Newton's laws of motion. Adding another sensor, such as a longitudinal gravitational sensor, allows the system to also measure a pitch angle, thereby providing estimation of two angular degrees of freedom. U.S. Pat. No. 4,561,188 discusses an example of a indicator system for two degrees of freedom. U.S. Pat. No. 7,121,355 discusses an example of an automatic system for two degrees of freedom.

Angle-measuring systems are not limited to determining and controlling machine attitude. They also help form a desired height profile (for example, a flat horizontal profile is attained by keeping both the pitch angle and the roll angle constant during grading). Such systems, however, provide low-accuracy grading since they are insensitive to blade-height variations (errors), such as those arising from the factors discussed above. Inaccuracies also arise from the gravitational sensors themselves, since they are sensitive to dynamic accelerations caused by machine motion. These inaccuracies are particularly significant for longitudinal sensors, since dynamic acceleration is maximal along the longitudinal axis. Due to the accumulation of height errors, the actual profile can differ in height from the desired profile by a considerable value (at least tens of cm), especially for sites which span a long distance. Inertial sensors alone may not be sufficient to detect changes in the height profile. For example, the bulldozer angular position at a local point may remain fixed at the same value as the one at the initial setting (for example, it may have been set to horizontal at the beginning of the swath) but the height can be considerably different from the initial one.

To enhance the system operability, a number of height-measuring sensors can be added. U.S. Pat. No. 5,917,593, for example, discusses a system including a mast with a vertical linear photocell array installed on the blade. The array receives signals from a stationary laser transmitter (base station), which transmits a narrow laser beam rotating at a constant speed. The rotation axis is perpendicular to the axis of the laser beam. A laser plane is thereby formed in space which can be oriented horizontally or at an angle to the ground surface. By determining the number of the photocell receiving the laser beam at the current instant, the blade height with respect to the laser transmitter may be estimated. If a gravitational sensor is added to measure a roll angle, then two degrees of freedom [one linear (height) and one angular (roll)] can be determined and controlled, and the accumulated height error can be efficiently eliminated for the desired profile set as a plane. The main drawback of such systems is the inability to form complex profiles differing from a simple plane. Also, the range of operation is usually limited to a few hundreds of meters. To generate zig-zag planes, the slopes and positions of the transmitter must be changed. This process is inconvenient in practice.

Instead of a photocell array, systems for forming complex profiles may be equipped with a Global Navigation Satellite System (GNSS) receiver. Examples are discussed in US Patent Application Publication No. 2009/0069987 and U.S. Pat. No. 7,317,977. Another approach uses an optical prism, whose position is determined by a stationary laser robotic total station fixed on a construction site within a line-of-sight distance. Such a system can include a roll sensor or two or more GNSS receivers to estimate attitude. These systems can be also fitted with electronically controlled valves, which allow automation of the blade-drive process. Estimating six degrees of freedom enable attainment of centimeter-level accuracy for forming the complex terrain profile. The drawback of such systems is their high cost (up to hundreds of thousands US dollars) and the necessity of installing and managing a base station (a GNSS receiver with a modem to transmit differential corrections to the machine control board or a laser robotic total station).

Angular control systems with two degrees of freedom may be produced at low cost, and they may operate in a fully autonomous mode, without a base station. As discussed above, standard angular control systems have limitations with respect to attaining high-accuracy terrain profiles. What are needed are methods and apparatus for reducing height errors in angular control systems with two degrees of freedom.

BRIEF SUMMARY OF THE INVENTION

The blade on an earthmoving machine is controlled by a semiautomatic method. In an embodiment, a manual operational mode is entered in response to a first user-issued command. The height of the blade is set to a user-specified height in response to a user-issued height control signal. An automatic operational mode is entered in response to a second user-issued command. A plurality of pitch-angle measurements is received. A reference pitch angle and a control point are set. The height of the blade is then automatically controlled based at least in part on the control point, the reference pitch angle, and the plurality of pitch-angle measurements. Automatic control is effective over a particular range of soil conditions. When the automatic control range is exceeded, the operator manually shifts the control point, and automatic control resumes about the new control point.

The slope of the blade can also be controlled. In the manual operational mode, the slope of the blade is set to a user-specified slope in response to a user-issued slope control signal. In the automatic mode, a plurality of roll-angle measurements is received, and a reference roll angle is set. The slope of the blade is then automatically controlled based at least in part on the reference roll angle and the plurality of roll-angle measurements.

These and other advantages of the invention will be apparent to those of ordinary skill in the art by reference to the following detailed description and the accompanying drawings.

DETAILED DESCRIPTION

Figure 1:
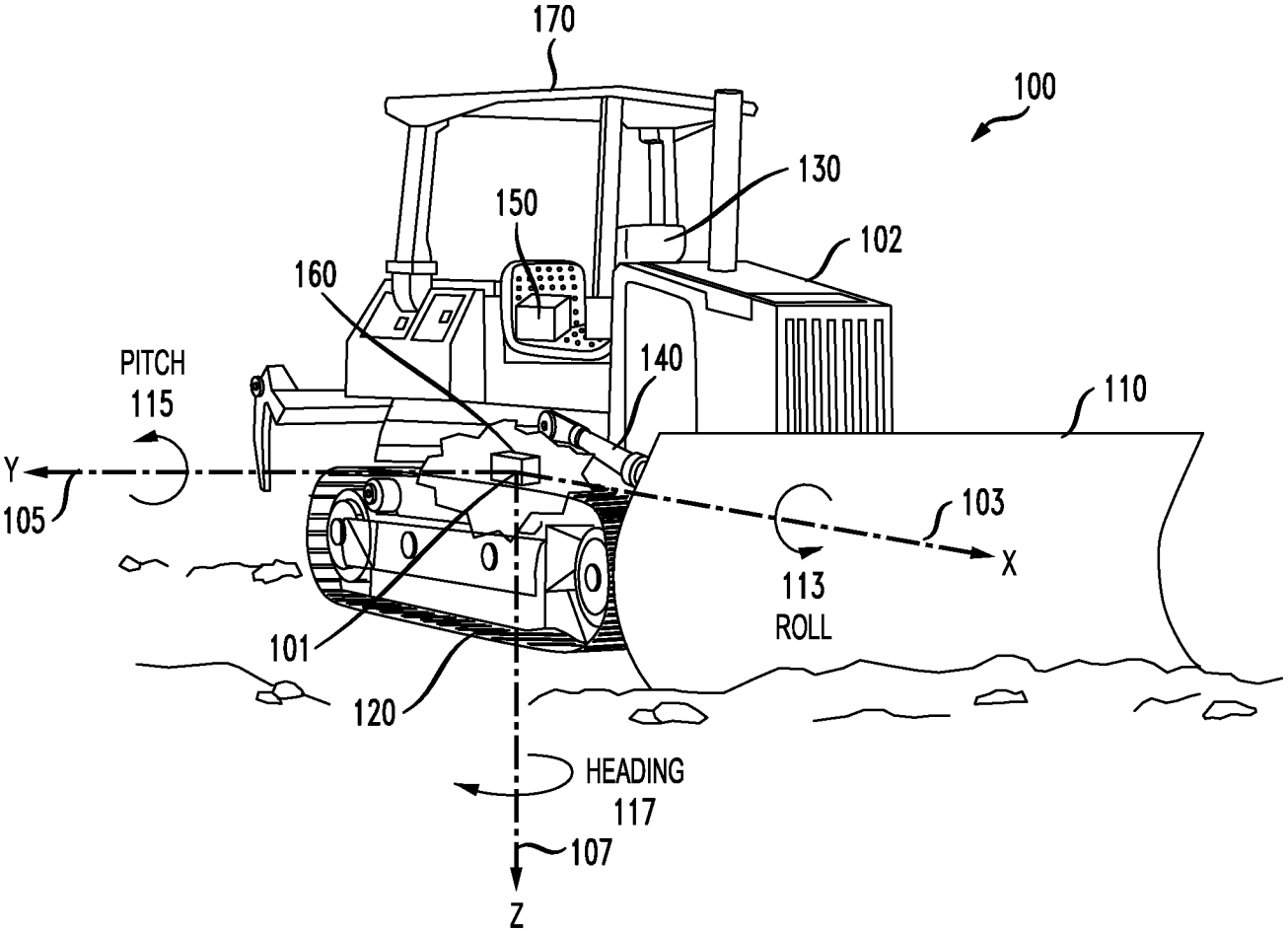
FIG. 1 shows a schematic of a dozer.

FIG. 1 shows a bulldozer 100 as one example of an earthmoving machine. Herein, a bulldozer is also referred to simply as a dozer. The major elements of dozer 100 include dozer body 102 and blade 110. For high-quality grading, the attitude of dozer body 102 is estimated. The estimation of attitude can be done by various devices. For example, two or three Global Navigation Satellite System (GNSS) or optical receivers may be installed on dozer body 102. By estimating the receiver positions, an attitude may be calculated. For reduced cost and autonomous operation, inertial sensors are advantageous. An assembly including one or more inertial sensors equipped with electronic devices to process output signals is called an inertial measurement unit (IMU).

IMU 160 is installed inside dozer body 102. A Cartesian coordinate system XYZ is fixed to the dozer body 102; the center 101 of the Cartesian coordinate system coincides with the sensitivity center of IMU 160. The X-axis 103 is aligned along the longitudinal direction; the Y-axis 105 is aligned along the transverse direction; and the Z-axis 107 is aligned along the vertical direction. The rotation angles about the X-axis 103, Y-axis 105, and Z-axis 107 are referred to as roll angle 113, pitch angle 115, and heading angle 117, respectively. These three angles define the attitude of dozer body 102 in space. Pitch angle 115 and roll angle 113 are measured from the horizontal plane, while heading angle 117 is measured from the North direction. The directions (X-axis 103, Y-axis 105, Z-axis 107) and angles (roll angle 113, pitch angle 115, heading angle 117) follow the right-hand rule.

Figure 10:
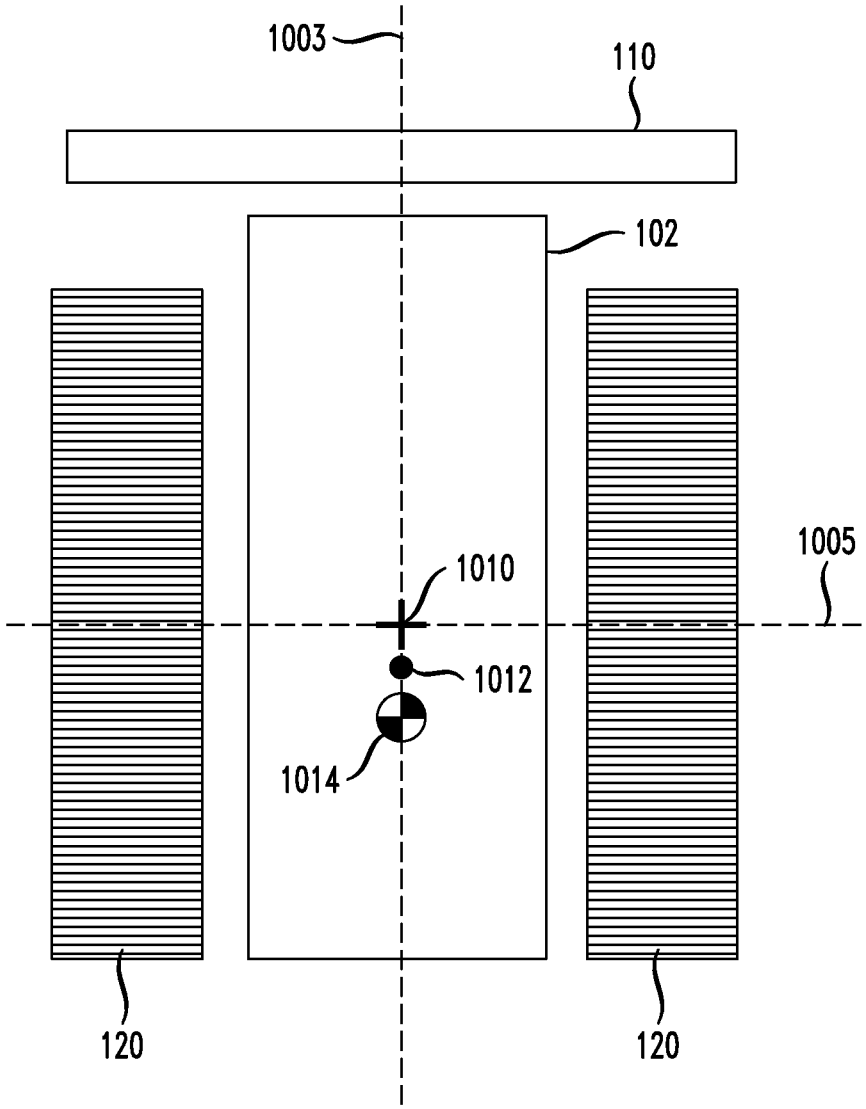
FIG. 10 shows the placement of an inertial measurement unit.

FIG. 10 shows a projection image of dozer 100 onto the ground. Shown are the projection images of tracks 120, dozer body 102, and blade 110. Axis 1003 is the longitudinal axis of symmetry of dozer body 102. Axis 1005 is the transverse axis of symmetry of tracks 120. The reference points shown are the intersection of axis 1003 and axis 1005 (referred to as intersection point 1010) and the machine center of gravity 1014. The intersection point 1010 is the point relative to which the dozer 100 is turning when tracks 120 rotate at the same speed but in opposite directions. For advantageous operation, the IMU 160 may be installed along axis 1003 between the intersection point 1010 and the center of gravity 1014. The optimal IMU position 1012 is the IMU position relative to which the root mean square (rms) value of dynamic accelerations encountered in moving the machine are minimal. In practice, however, restrictions due to mechanical constraints of the dozer construction may not permit the IMU 160 to be placed at the optimal point; in this instance, the best position should be chosen from the available positions.

Blade 110 is pivotally connected to the dozer body 102. The blade 110 can move in space relative to the dozer body 102 with the assistance of hydraulic cylinders. A pair of hydraulic cylinders 140 drive the blade 110 vertically, up and down along Z-axis 107 (elevation channel). One of the hydraulic cylinders 140 (on the right-hand side of dozer body 102) is visible in FIG. 1; a matching cylinder on the left-hand side is hidden from view. The blade 110 also rotates about X-axis 103 (slope channel) via a separate hydraulic cylinder (not shown). Hereinafter, the term "slope" refers to the degree of tilt of the blade, and the term "roll" refers to the degree of tilt of the dozer body. In the process of grading, the blade 110 may be moved continuously in the elevation channel and in the slope channel to provide the desired profile. Some models of dozers also have the capability to rotate the blade 110 around the Z-axis 107. This rotation, as well as other adjustments of the blade, are used to efficiently cut and shove towards the soil. With these other adjustments, the blade position is usually set one time before cutting the given swath.

Figure 2:
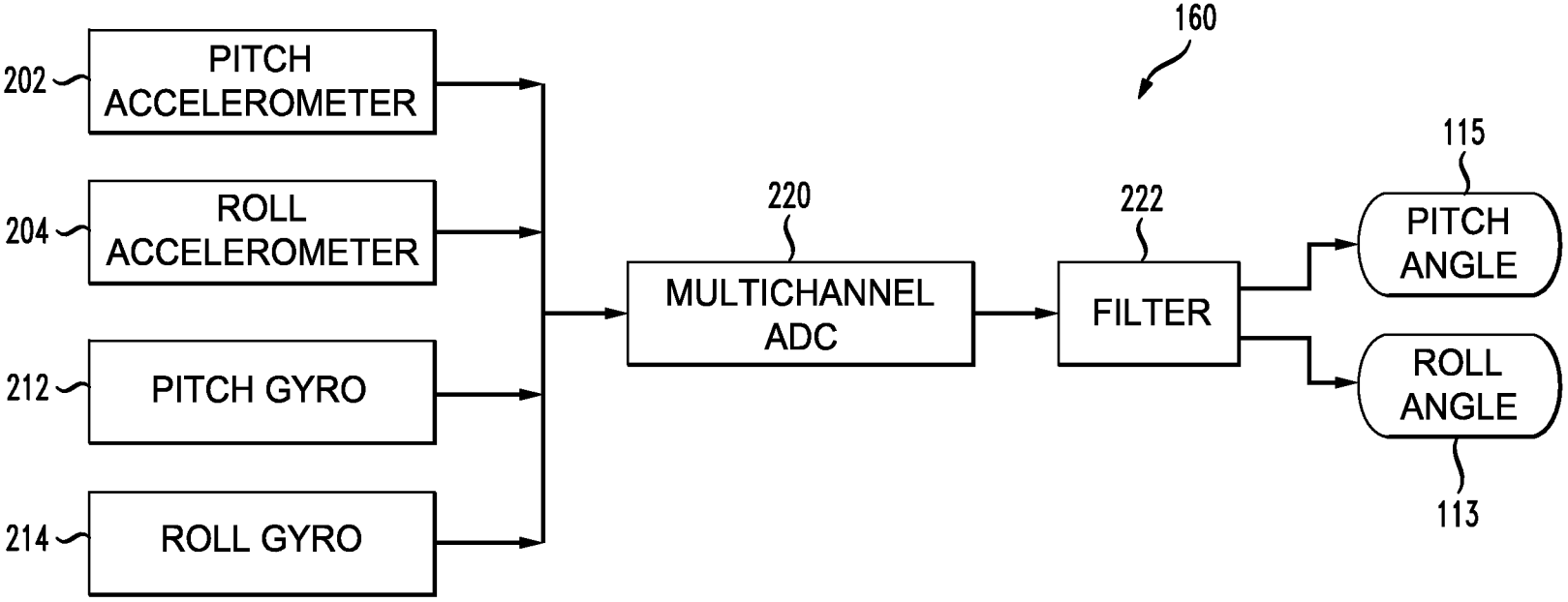
FIG. 2 shows a schematic of an inertial measurement unit.

To grade ground based on machine attitude, pitch angle 115 and roll angle 113 are estimated. If there is a requirement to aid dozer operation only along a straight line, estimating the heading angle 117 is not necessary. FIG. 2 shows an embodiment of IMU 160. It includes pitch accelerometer 202 and roll accelerometer 204 for measuring pitch angle and roll angle, respectively, based on the projection of the gravitational acceleration vector onto two perpendicular sensor axes that are parallel to Y-axis 105 and X-axis 103, respectively. Micro-Electro-Mechanical Systems (MEMS) devices may be used for these accelerometer sensors; they provide angular measurements within a wide range and possess low nonlinearity and delay. Liquid inclinometers may also be used. In addition to measuring the gravitational acceleration projection, however, these devices also detect unwanted components caused by motion of the machine. To compensate for the unwanted components, two gyros, pitch gyro 212 and roll gyro 214, that measure projections of the angular speed vector onto two perpendicular axes parallel to Y-axis 105 and X-axis 103, respectively, may be used. MEMS devices based on measuring the Coriolis force proportional to angular speed may be chosen as suitable units. A fiber optic gyro (FOG) exploiting the Sagnac effect may also be used.

Sensor signals from pitch accelerometer 202, roll accelerometer 204, pitch gyro 212, and roll gyro 214 are digitized in a multichannel analog-to-digital converter (ADC) 220 and filtered in filter 222 to estimate pitch angle 115 and roll angle 113. In an embodiment, filter 222 is a Kalman-type filter.

Figure 3:
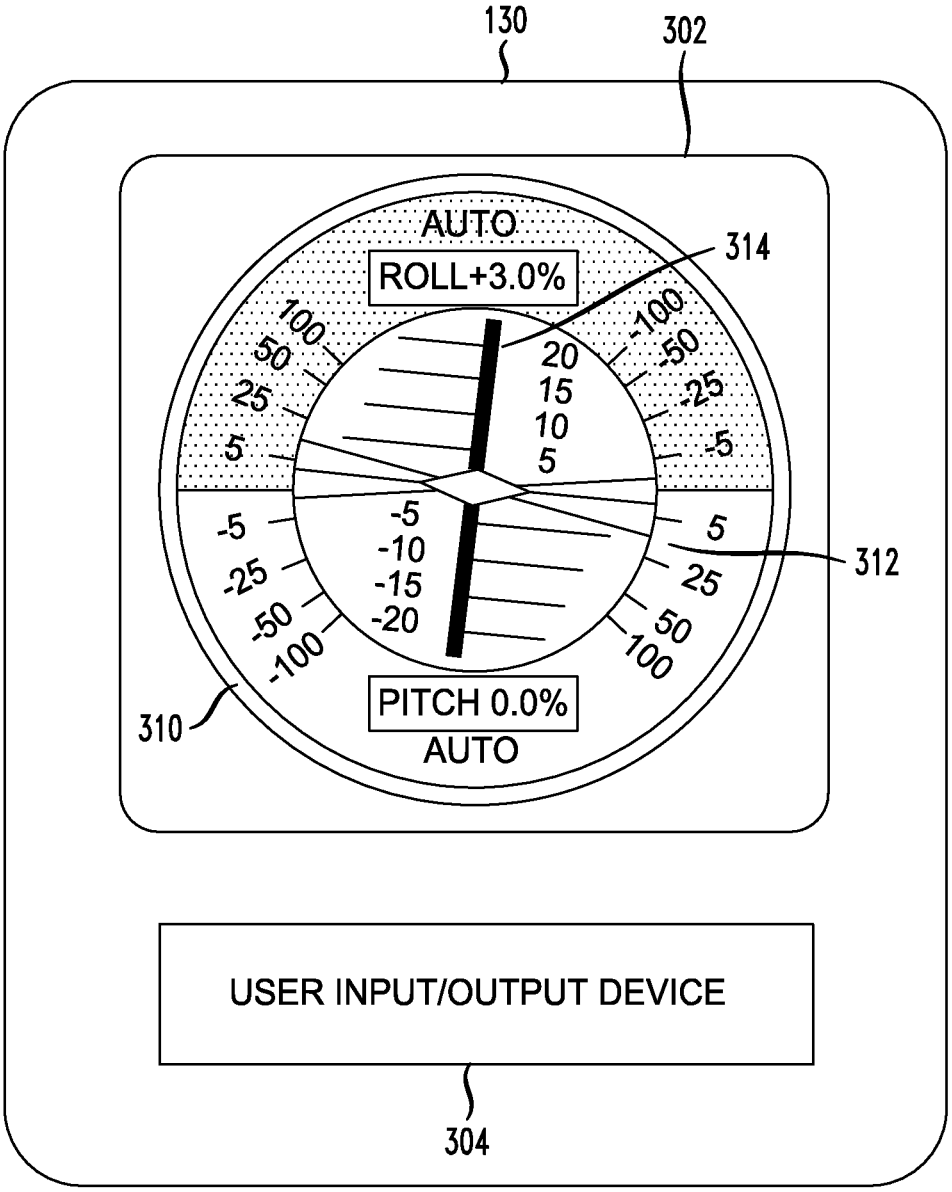
FIG. 3 shows a schematic of a control console.

To control the system and to visually display estimates for pitch angle 115 and roll angle 113, a console 130 is installed in the dozer cab 170 (refer to FIG. 1). One embodiment of console 130 is shown in FIG. 3. Console 130 includes display 302 (for example, a liquid crystal display) and user input/output device 304 (for example, a keyboard or touch screen). Display 302 displays the indication of pitch angle 115 and roll angle 113 with respect to an artificial horizon 310. Artificial horizon 310 allows the operator to observe both angles (roll and pitch) at a single glance and operate a manual control on the machine to maintain a desired attitude. The outer circular scale 312 shows the roll angle, and the inner vertical scale 314 shows the pitch angle. The angles are expressed in percent, where percent=100 tan(angle), with angle measured in radians.

Figure 4:
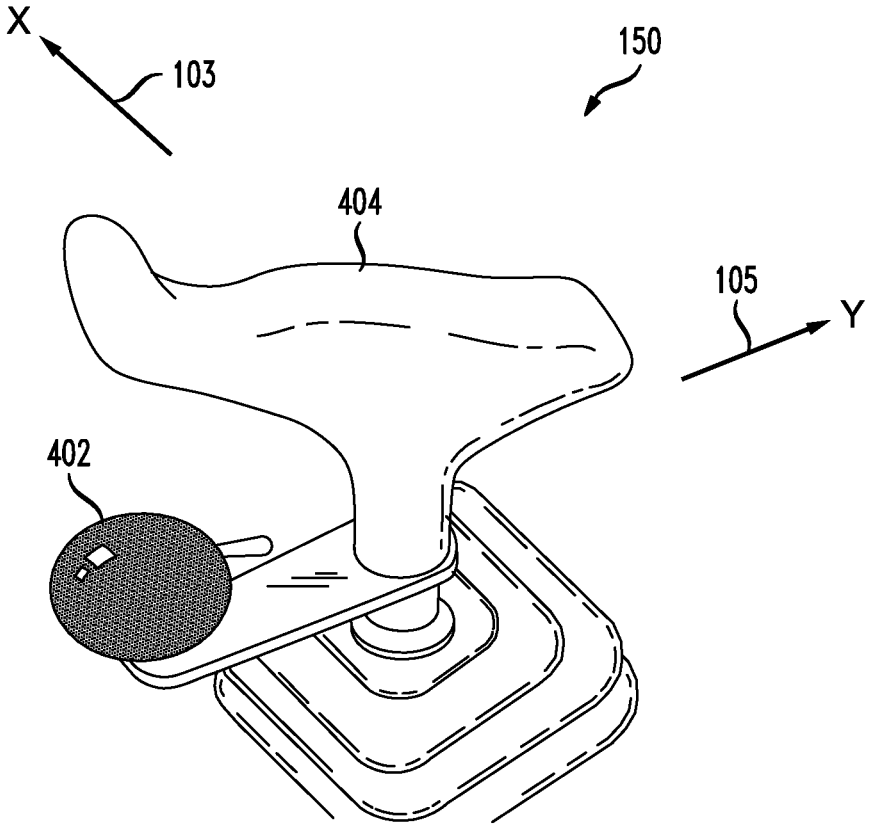
FIG. 4 shows a schematic of an operator controller box.
Figure 5A:
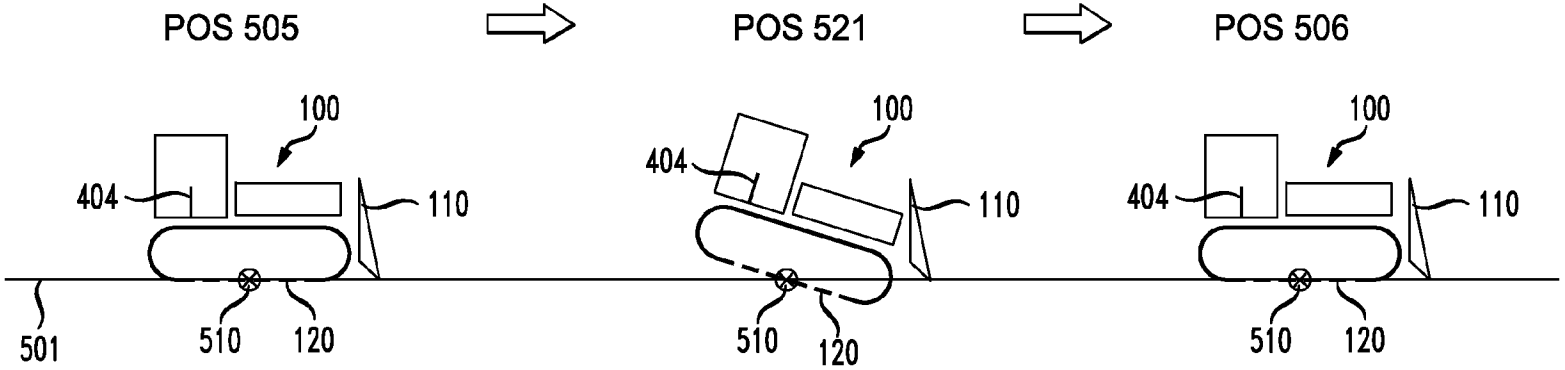
FIG. 5A-FIG. 5F show different positions of a dozer body relative to the ground.
Figure 5B:
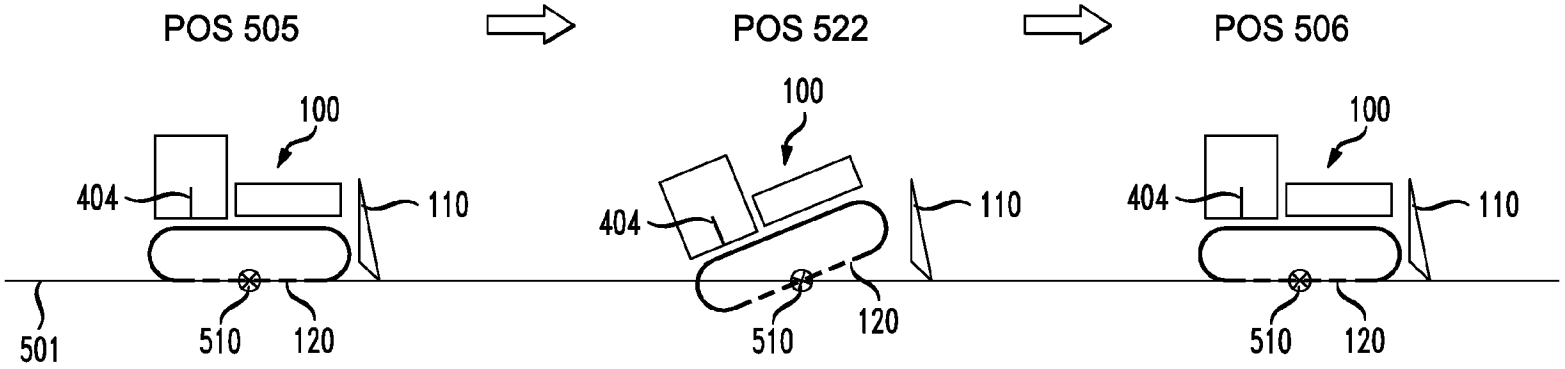
Figure 5C:
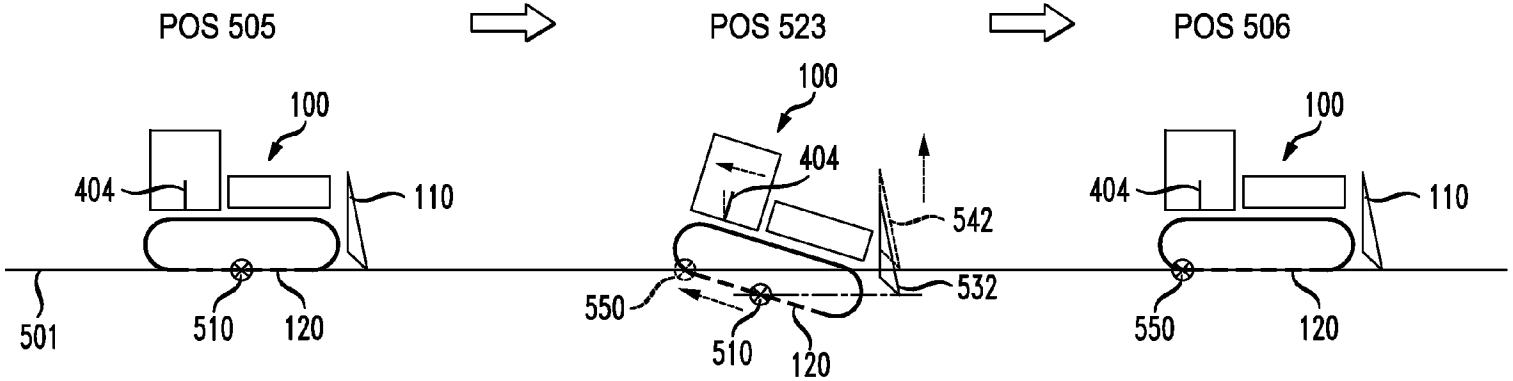
Figure 5D:
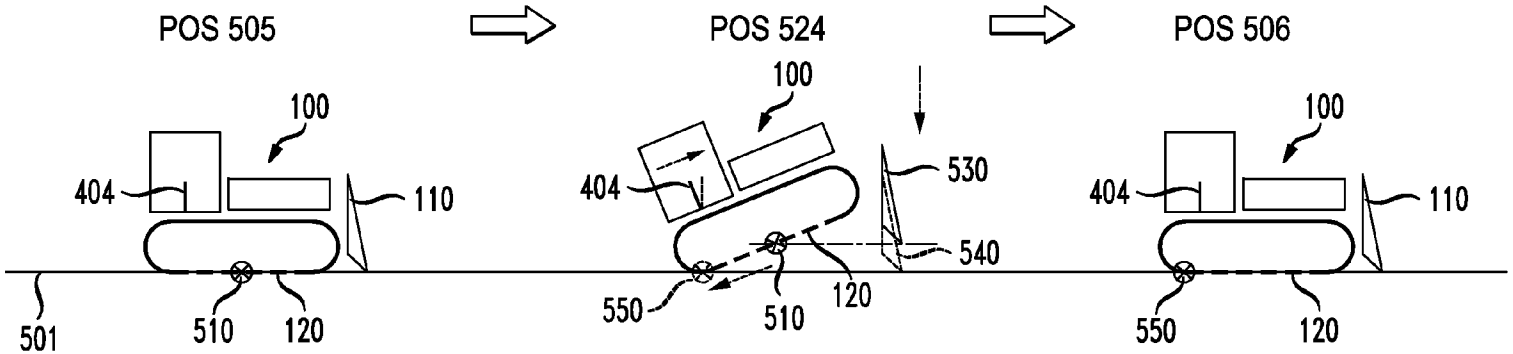
Figure 5E:
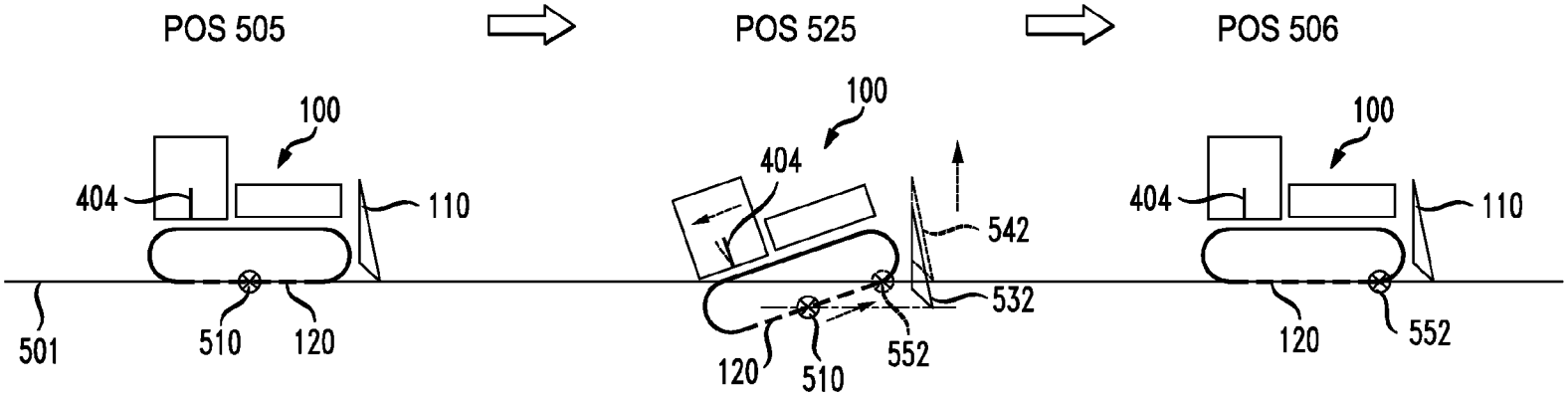
Figure 5F:
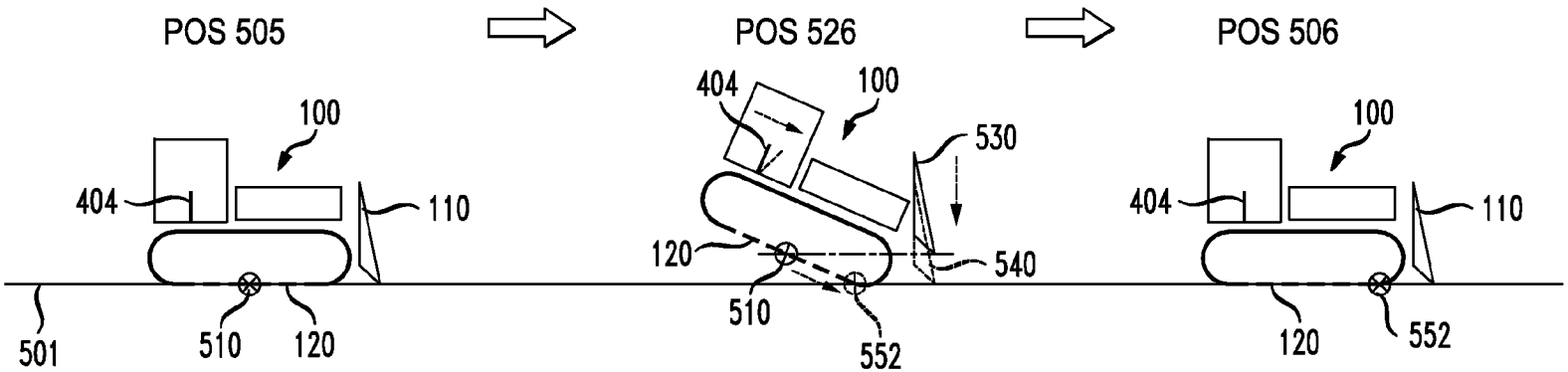

The user (dozer operator) controls the motion of the dozer blade 110 with the assistance of control box 150, also installed in the dozer cab 170 (see FIG. 1). An embodiment of control box 150 is shown in FIG. 4. Control box 150 includes auto/manual switch 402 and two-directional joystick lever 404. During manual operation, the dozer operator views the artificial horizon 310 and shifts the two-directional joystick lever 404 to move the blade 110 to obtain the desired pitch angle 115 and roll angle 113 while blade 110 scrapes the ground moving forward. More details of the relationship between blade movement, pitch angle, and roll angle are described below.

In an embodiment, movement of joystick lever 404 along the longitudinal direction (X-axis 103) controls the elevation channel. If the joystick lever 404 moves forward (+X), the blade 110 moves down and digs deeper into the ground. The pitch angle 115 of the dozer body 102 will decrease while the dozer 100 runs on the freshly-scraped piece of the ground. If the joystick lever 404 moves backward (−X), the blade 110 moves up. If the blade is not run out of load, this movement will increase the pitch angle 115. (A blade is run out of load if there is no soil heap in front of the blade.) Movement of the joystick lever 404 along the transverse direction (Y-axis 105) controls the slope channel. If the joystick lever 404 moves to the right (+Y), the right edge of the blade 110 moves down, digging into the ground, and the left edge moves up. This movement will increase the roll angle 113 of the dozer body 102. If the joystick lever 404 moves to the left (−Y), the right edge of the blade 110 moves up and the left edge moves down. This movement will decrease the roll angle 113. The speed of moving the blade 110 is proportional to the angle at which the joystick lever 404 deviates from the vertical. Note that the movement direction of the joystick lever 404 (forward, backward, right, left) is referenced from the perspective of the dozer operator. The quality of the grading in the manual mode is dependent on how quickly the operator reacts to the indications of the artificial horizon 310.

In another embodiment, the blade 110 is automatically controlled. In this process, the relative positions of the blade 110 and the dozer body 102 are determined to calculate how deep blade 110 is buried into the ground. For example, they may be determined by equipping the blade hydraulic cylinders with linear sensors measuring displacement of the cylinder shafts. In particular, hydraulic cylinders 140 (see FIG. 1), which move the blade 110 in the vertical direction, are fitted with sensors. Different types of sensors may be used to measure relative position: for example, potentiometric sensor, magnetoresistive sensor, and laser distance meter. In general, the relative position of the blade 110 may also be measured without direct measurement of shaft displacement. For example, video sensors to measure positions, as discussed in European Patent Application No. 09156186.0, may be used. Two or three video cameras may be fixed to the dozer body 102, and distinctive marks (easily visible among the environment background) are placed on blade 110. Based on the mutual positions of the marks, the mutual position of the blade 110 and dozer body 102 may be determined by processing the stream of video data. For this particular task, the term 'displacement sensors' is used to refer to any sensors suitable for measuring the relative position of blade 110 and dozer body 102.

As discussed above, auto/manual switch 402 allows the dozer operator to switch between manual and automatic operation. In one procedure, before starting the following swath, the dozer operator switches to manual mode and cuts a part of the ground such that the blade 110 will be at the desired (user-specified) height, while the dozer body 102 will be oriented at the desired pitch angle 115 and desired roll angle 113. Then, the dozer operator switches over to the automatic mode. The dozer keeps moving in automatic mode, while the pitch angle 115 and the roll angle 113 at the instant of switching from "manual" to "automatic" are used as reference values and kept constant. Alternatively, a desired blade height may be set in the manual mode, and desired values of the angles may be entered into the console 130 via user input/output device 304 (see FIG. 3). Then these user-specified values will be used as reference values after switching from the manual mode to the automatic mode.

In some instances, a zig-zag profile is desired. A zig-zag profile comprises multiple separate segments in which each segment has a different specified pitch angle (and sometimes a different specified roll angle). At the beginning of each segment, the operator first switches to manual mode, cuts the ground at the pitch angle and roll angle specified for the segment, and then switches to auto mode to complete the segment. The operator then repeats the procedure for each remaining segment.

Elevation and slope channels may be controlled independently; that is, the current slope channel does not affect the elevation channel, and the current elevation channel does not affect the slope channel. Controlling the slope channel is easier to accomplish because it is free of accumulating errors due to direct measurement of roll angle 113 by IMU 160. Controlling the elevation channel is more difficult. Controlling the elevation channel should be done to avoid the accumulation of height errors, as discussed above. Unwanted influence of the ground on the machine is taken into account.

Figure 11A:
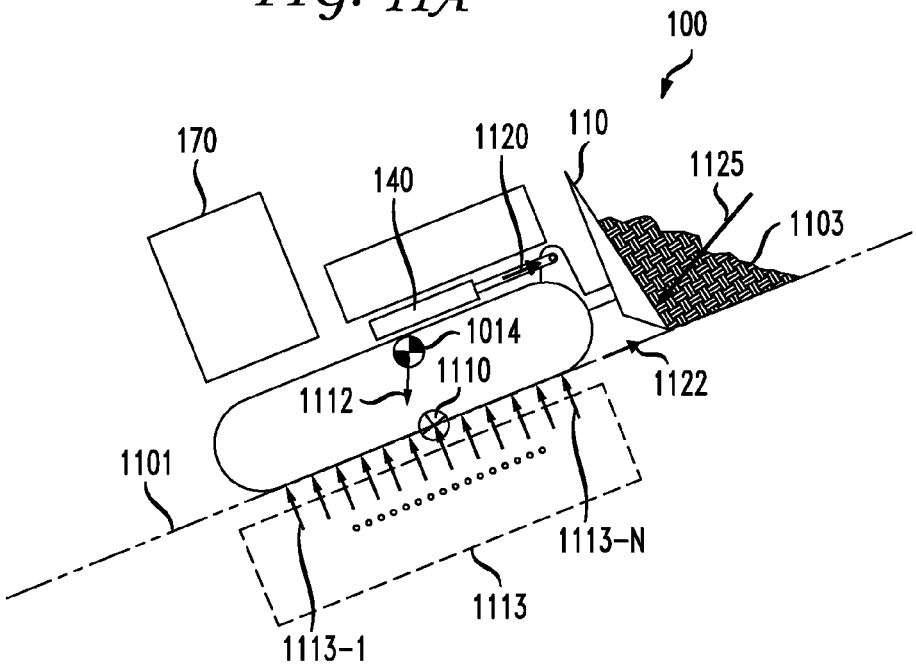
FIG. 11A and FIG. 11B show the forces acting on a dozer.

FIG. 11A shows a side view of dozer 100 and the principal forces that influence it during the grading process. Dozer 100 is controlled to create the desired ground profile 1101. The gravitational force vector 1112 points vertically down from the machine center of gravity 1014; the magnitude of gravitational force vector 1112 is equal to the weight of dozer 100. The magnitude of the gravitational force vector is nearly constant (the weight varies slightly depending on the volume of fuel in the dozer). The position of the machine center of gravity is also nearly constant (the position varies slightly depending on the volume of fuel in the dozer and the relative position of the blade with respect to the body). The angle between the gravitational force vector and an axis fixed to the body will vary with the pitch and roll. Under typical operating conditions, the traction force vector 1122 points approximately along the bottom of the tracks. Under certain operating conditions, however, traction force vector 1122 can point along other directions; for example, if a substantial portion of the tracks is lifted off the ground, the traction force vector 1122 can point along the ground. It is pointed forward when dozer 100 is travelling in the forward direction and pointed backward when dozer 100 is travelling in the reverse direction. The magnitude of the traction force vector 1122 depends on several factors, including the dozer engine power, transmission, undercarriage, and adhesion friction between the tracks and the ground.

Figure 11B:
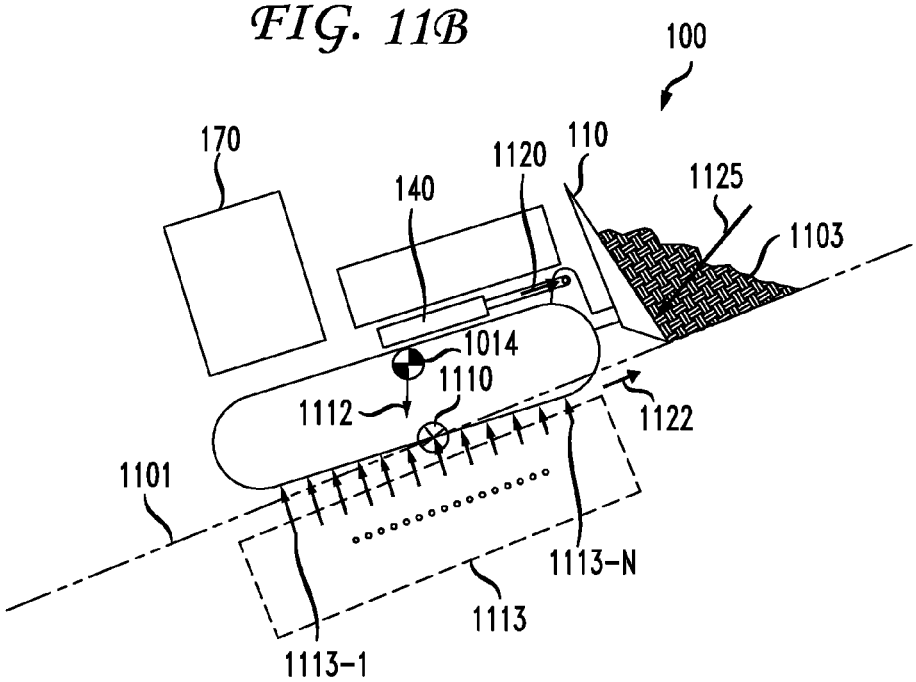

The pair of hydraulic cylinders 140 generates drive force 1120 which moves the blade 110. Drive force vector 1120 is pointed along the shafts of the pair of hydraulic cylinders 140. The direction and magnitude of drive force vector 1120 can be manually controlled by an operator or automatically controlled. The resistance force vector 1125 of soil resistance to cutting and dragging depends on the volume, weight, and condition of soil heap 1103 in front of the blade 110 and the condition of the ground under the bottom edge of blade 110. The direction and magnitude of resistance force vector 1125 is very unsteady. A typical direction for a case of a loaded blade is shown in FIG. 11A; the magnitude typically increases during the grading process as the volume of soil heap 1103 increases towards the end of the swath. The set of ground reaction force vectors 1113 [comprising ground reaction force vectors (1113-1, . . . , 1113-N) where N is an integer greater than 1] is distributed along the track surface in contact with the ground and perpendicular to it. For homogeneous ground, as shown in FIG. 11A, all of the ground reaction force vectors (1113-1, . . . , 1113-N) have the same magnitude. For inhomogeneous ground, as shown in FIG. 11B, the magnitudes of the ground reaction force vectors (1113-1, . . . , 1113-N) vary along the track surface. Consequently, the dozer pitch will be changed, and the dozer will rotate around control point 1110. The concept of a control point is discussed in further detail below.

Define $M_i$ as the moment of the i-th external force (where i is an integer ranging from 1 to n), about a point placed on the bottom surface of the tracks. The control point 1110 is then defined by the equation:

$$\mathrm{abs}\left(\sum_{i=1}^{n} M_i\right) = \min. \tag{E 1}$$

That is, the control point 1110 yields the minimum absolute value of the sum of the moments. The equation (E1) defines the condition under which the dozer configuration is in a state of equilibrium. If the state of equilibrium is stable, after a small short-term displacement caused by changes in the distribution of external forces, the dozer returns itself to its original equilibrium configuration. In FIG. 11B, such displacement is caused by changes in the set of ground reaction forces 1113. To avoid incorrect cutting of ground during displacement, the blade 110 should be automatically moved up to set it on the desired profile 1101: that is, the blade should be controlled in such a manner that allows both the bottom edge of blade 110 and control point 1110 to lie on profile 1101.

If there are long-term changes in the distribution of external forces, the dozer will not return itself to its original equilibrium configuration. Under typical operating conditions, long-term changes in the distribution of external forces result primarily from ground reaction forces and soil resistance to cutting and dragging. Equation (E1) for the current control point then becomes invalid, and the control point should be moved along the bottom surface of the tracks until equation (E1) is once again satisfied. Thus, depending on factors such as the current ground density, ground inhomogeneity, and blade load, the position of the control point along the track should be changed such that the height deviation of the control point from the desired profile would be minimal.

In an embodiment, the distribution of external forces is not directly measured, and the control point position is not directly calculated. The position of the control point is moved based on observation of dozer behavior. The operator visually observes the current blade height relative to reference objects (for instance, geodetic markers) or to features on the ground (for instance, a neighboring swath) located alongside of the current swath. Operation of the dozer is based on human reflex and prior knowledge of dozer behavior. The operator moves the control point manually to avoid long-term undesirable changes in dozer position. The overall process is referred to herein as semiautomatic dozer control. In the automatic segment of the process, the bottom edge of blade 110 and control point 1110 are automatically maintained on profile 1101. In the manual segment of the process, the operator manually shifts the control point to satisfy the condition of equation (E1).

FIG. 5A-FIG. 5F show examples of semiautomatic control under a variety of soil conditions. The machine movement in the vertical plane is used for illustration. In general, the initial terrain is arbitrary. In these examples, assume that a horizontal profile 501 needs to be constructed. In each example, in manual mode, the dozer 100 is moved to the starting position, POS 505. Different intermediate positions, POS 521-POS 526 (as shown in FIG. 5A-FIG. 5F), are shown for a variety of soil conditions. Appropriate control action (manual or automatic) is applied at the intermediate positions to attain the target position, POS 506.

Details shown in the figures are tracks 120, blade 110, and joystick lever 404. In the starting position, POS 505, the control point position is located at control point 510, close to the bottom projection of the machine center of gravity. The bottom edge of blade 110 touches profile 501 and is on the same level as control point 510. In the general case, the controller task is to place both the position of the edge of blade 110 and the control point 510 on the desired profile 501 being set by the reference pitch at system initialization. System intialization refers to the instant at which control is transferred from manual to auto. Embodiments of a controller are discussed in further detail below.

Auto/manual switch 402 (FIG. 4) is then switched into auto position, and the dozer 100 moves forward. Depending on the ground influence, the dozer body position (spatial and angular) can start to change, and this change should be compensated by the controller. FIG. 5A-FIG. 5F show examples of different dozer body positions (intermediate positions POS 521-POS 526). Positions POS 521, POS 522, POS 523, and POS 525 are typical for swampy ground; for instance, water-filled sand. Positions POS 524 and POS 526 are typical for hard soil; for instance, dry loam. In positions POS 521 and POS 522, control point 510 remains on profile 501. In positions POS 523, POS 524, POS 525, and POS 526, the control point position should be shifted either up or down relative to profile 501; however, the bottom surface of tracks 120 continues to intersect the profile 501 either at the front or rear end of tracks 120. These intersection points define the range of the control point positions and limit the degree to which the controller can maintain the desired profile 501. Similar control procedures apply for intermediate positions of the control point between the front and rear end of the tracks 120.

There are instances when the bottom surface of tracks 120 is either fully over or fully under profile 501; that is, when there are no intersection points of the bottom surface of tracks 120 and profile 501. These instances are ill-characterized, and arise, for example, when the dozer position is in one of POS 523, POS 524, POS 525, and POS 526, and the operator does not perform a correction in the control point position in time. In these instances, height error results. If the operator, even late, corrects the position of the control point, however, further accumulation of height error will be mitigated.

In positions POS 521 and POS 522, the controller automatically sets the bottom edge of blade 110 at the same level as control point 510. The dozer 100 then leaves the perturbed area and returns to the target position POS 506. In this case, height errors have not occurred and accumulated.

In positions POS 523, POS 524, POS 525, and POS 526, if the operator does not intervene, the controller would set erroneous blade positions (blade position 530 and blade position 532) that would cause further height error. To avoid this error, the operator visually orients the current blade height relative to specific objects (for instance, geodetic markers) or ground features (for instance, neighboring swath) located alongside of the current swath. The operator moves the joystick lever 404 while the auto/manual switch 402 remains in the auto position. The operator moves the joystick lever 404 forward to drive the blade 110 downward into blade position 540. Similarly, the operator moves the joystick lever 404 backward to move the blade 110 upward into blade position 542. These operations are performed without stopping the dozer 100.

While the auto/manual switch 402 is in the auto position, the control signal generated by movement of the joystick lever 404 does not directly control the hydraulic cylinders 140 (see FIG. 1). Instead, a new position of the control point is sent to the controller. As discussed above, the control point position is shifted along tracks 120. The angular deviation of joystick 404 from the vertical controls the speed at which the control point position is changed; that is, the speed is proportional to the angular deviation with some gain coefficient.

At the negative pitch as shown in position POS 523, if the operator wants to move the blade 110 up into blade position 542, the control point position shifts backward from control point 510 to control point 550. At the positive pitch as shown in position POS 525, if the operator wants to move the blade 110 up into blade position 542, the control point shifts forward from control point 510 to control point 552. At the positive pitch shown in position POS 524, if the operator wants to move the blade 110 down into blade position 540, the control point moves back from control point 510 to control point 550. At the negative pitch shown in position POS 526, if the operator wants to move the blade 110 down into blade position 540, the control point shifts forward from control point 510 to control point 552.

The controller determines the change of the control point position; the blade 110 returns to the desired profile 501; and the dozer position returns to the target position POS 506. If the ground properties and blade load do not change significantly, the control point remains at the shifted positions (control point 550 or control point 552) as dozer 100 continues to travel. Additional operator intervention is not needed, and there no height error accumulation. If the external conditions do change significantly, the blade height will change. The operator therefore needs to intervene and shift the control point. The actions that the operator performs to correct height errors in the semiautomatic mode are similar to the typical actions of blade control in the manual mode; however, operator action (if required) is relatively infrequent compared to the manual mode when the operator has to continuously correct blade positions.

Note that in target position POS 506, there are three control points (control point 510, control point 550, and control point 552) shown in FIG. 5A-FIG. 5F even though the relative positions and orientations of the dozer body and blade are the same. The different control points result from different distributions of external forces (not shown), arising, for example, from different soil conditions. As previously discussed with respect to equation (E1), the control point depends on the distribution of external forces.

Figure 6A:
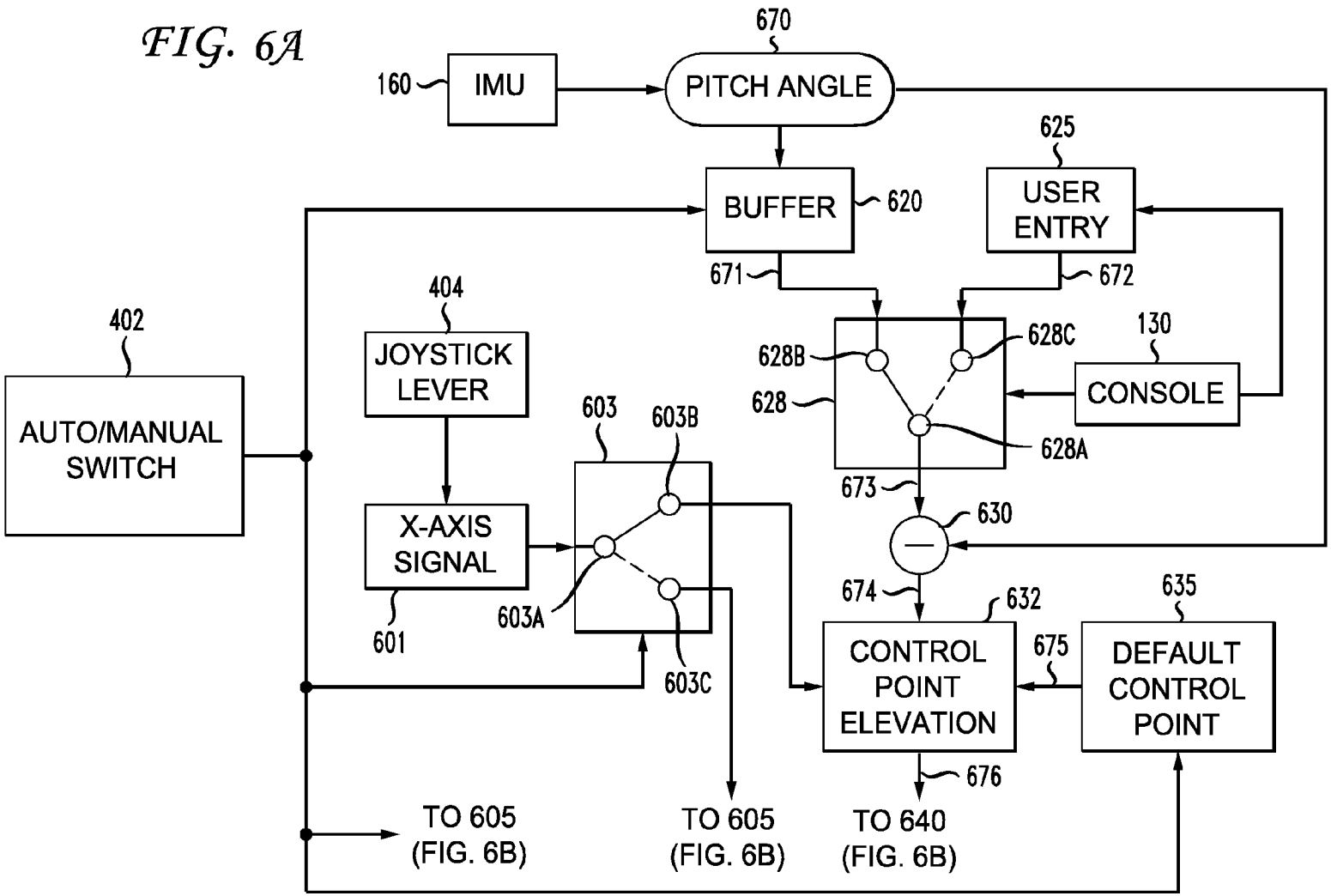
FIG. 6A and FIG. 6B show schematics of a process for blade elevation control.
Figure 6B:
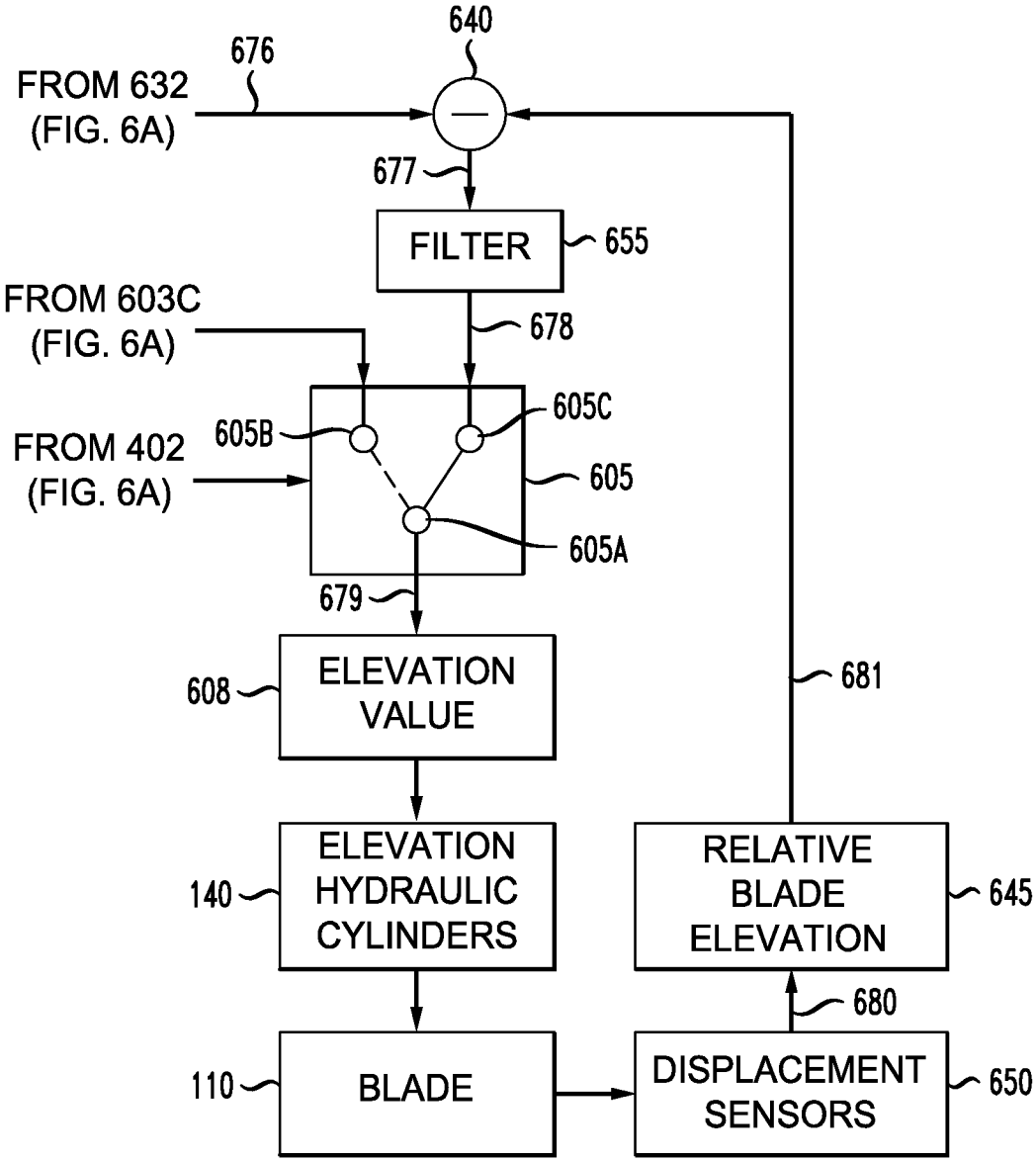

An embodiment of an operational process for controlling the elevation channel is shown in the block diagrams of FIG. 6A and FIG. 6B. The blocks shown refer to functional blocks. Refer to FIG. 6A. At the beginning of the swath, the operator switches the auto/manual switch 402 (FIG. 4) to the manual position and sets the blade 110 (FIG. 1) at the desired height. The operator moves the joystick lever 404 along the longitudinal direction (X-axis 103). This movement causes the control system to generate an X-axis control signal 601, which is inputted into port 603A of switch 603. In the manual mode, the X-axis control signal 601 is routed through port 603C of switch 603 and sent to port 605B of switch 605 (FIG. 6B). In the manual mode, X-axis control signal 601 is selected as the output 679 sent from the output port 605A of switch 605 to elevation valve 608, which controls the corresponding pair of elevation hydraulic cylinders 140 that drive blade 110 to the desired height.

Return to FIG. 6A. The auto/manual switch 402 is then switched to the auto position. The inertial measurement unit IMU 160 (FIG. 1) outputs measured pitch angle 670 into buffer 620, which is latched when the dozer operator switches the auto/manual switch 402 from the manual to the auto position. The measured pitch angle 670 is constantly updated; the set of measured pitch angles is referred to as pitch-angle measurements. The value of the pitch angle stored in buffer 620 is referred to as buffered pitch angle 671, which is inputted into port 628B of program switch 628. The dozer operator, using the user input/output device 304 on console 130 (see FIG. 3), can also enter a value of the pitch angle into the user-entry block 625. The value of the pitch angle entered into user-entry block 625 is referred to as user-specified pitch angle 672, which is inputted into port 628C of program switch 628. Using the console 130, the dozer operator can choose either the buffered pitch angle 671 or the user-specified pitch angle 672 as the reference pitch angle 673, which is outputted to port 628A of program switch 628.

The reference pitch angle 673 is inputted into subtracting unit 630. The measured pitch angle 670 is inputted into subtracting unit 630, which calculates a difference between the continuously measured pitch angle 670 and the reference pitch angle 673. The difference 674 is inputted into control point elevation calculation block 632. In the automatic mode, X-axis signal 601 is also outputted from port 603B of switch 603 to control point elevation calculation block 632.

A default control point value 675 is calculated by default control point calculation block 635. The default control point value 675 is determined at the instant of switching auto/manual switch 402 from manual into auto position. As discussed above, the default control point value 675 is typically set at the bottom projection of the machine center of gravity. The default control point value 675 is inputted into control point elevation calculation block 632. At the beginning of the calculations in control point elevation calculation block 632, the default control point value 675 from default control point calculation block 635 is used. If needed, by activating joystick lever 404, the operator can correct the control point elevation 676 calculated in control point calculation block 632. The algorithm of the calculation in control point elevation calculation block 632 is based on the principles described above in reference to equation (E1). Activating joystick lever 404 sends a control signal which changes parameters in the algorithm.

The calculated control point elevation 676 is inputted into subtraction unit 640 (see FIG. 6B). Displacement sensors 650 coupled to blade 110 input blade displacement values 680 (also referred to as height-displacement measurements) into relative blade elevation calculation block 645, which calculates estimated relative blade elevation 681 of blade 110 relative to dozer body 102. Estimated relative blade elevation 681 is inputted to subtraction unit 640, which calculates a difference 677 between the calculated control point elevation 676 and estimated relative blade elevation 681. The difference 677 determines how much the blade 110 needs to be moved up or down to maintain the control point on the desired profile (such as profile 501 in FIG. 5). The difference 677 is filtered in filter 655; in one embodiment, filter 655 is an amplifier with some gain coefficient. The filtered difference 678 is inputted into port 605C of switch 605. In the automatic mode, the filtered difference 678 is selected as output 679 from output port 605A of switch 605 and sent to elevation valve 608.

Figure 7A:
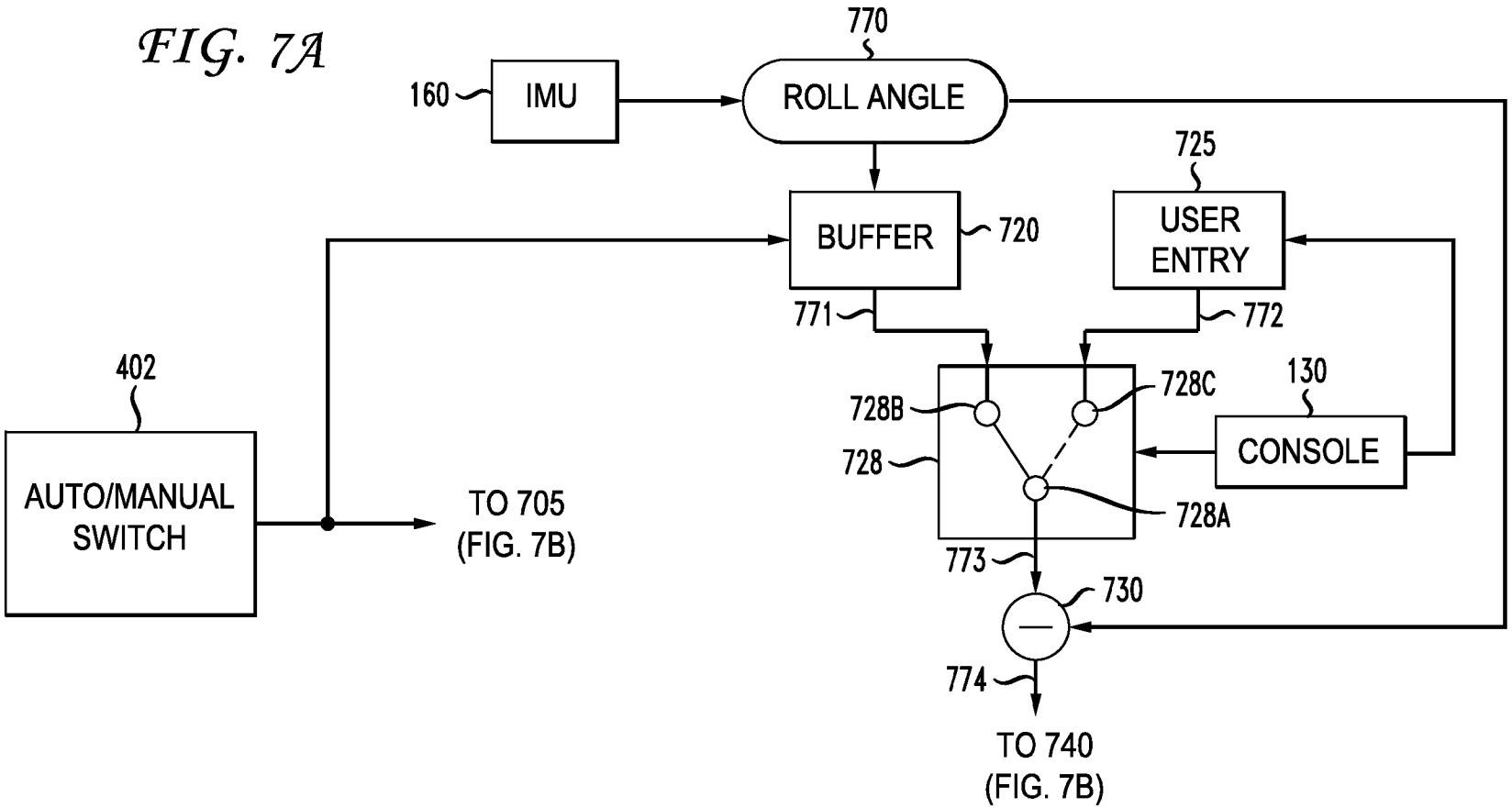
FIG. 7A and FIG. 7B show schematics of a process for blade slope control.
Figure 7B:
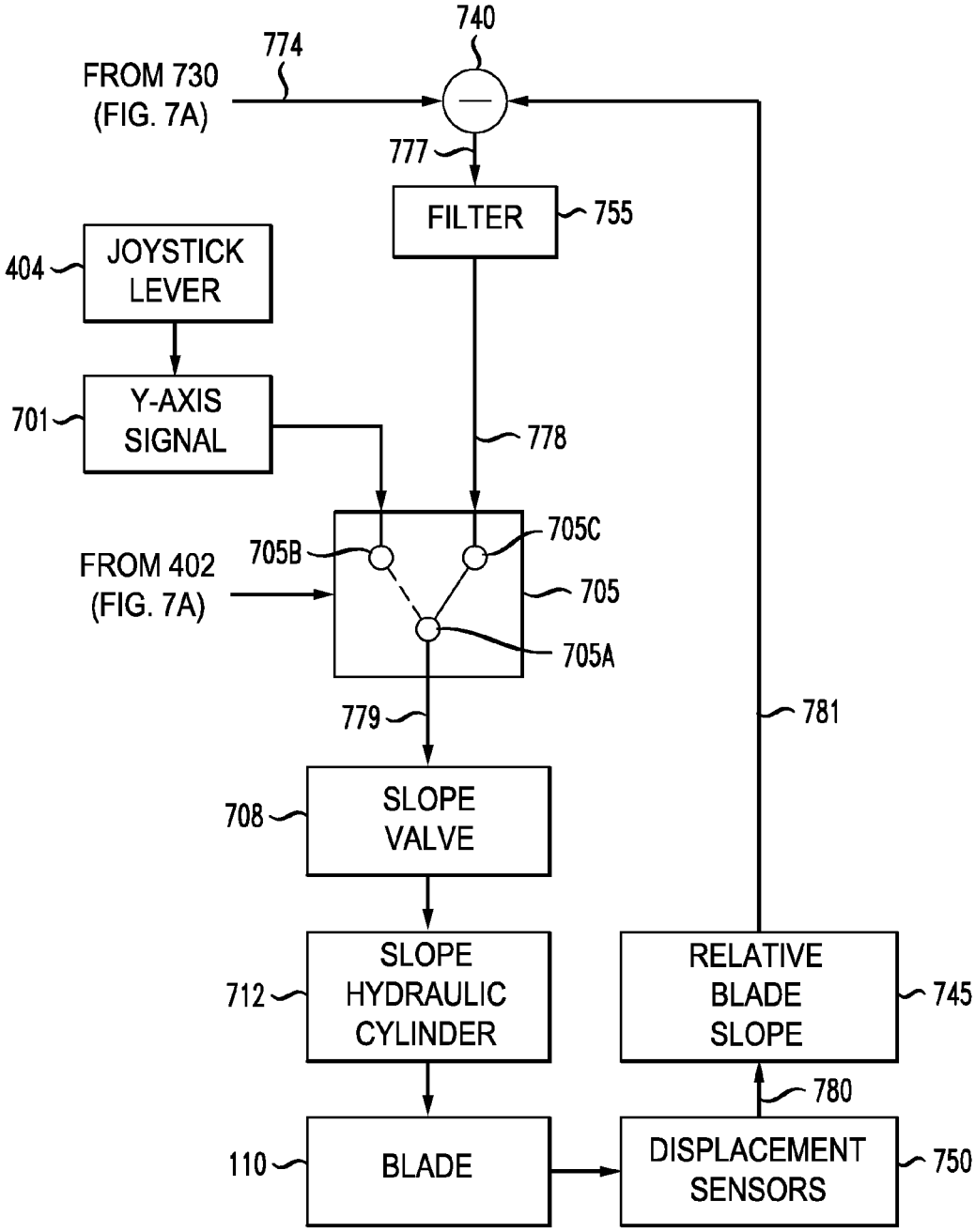

An embodiment of an operational process for controlling the slope channel is shown in the block diagrams of FIG. 7A and FIG. 7B. The blocks shown refer to functional blocks. Refer to FIG. 7A. At the beginning of the swath, the dozer operator switches the auto/manual switch 402 (FIG. 4) to the manual position and sets the dozer body 102 at the desired roll angle. In FIG. 7B, the dozer operator moves the joystick lever 404 along the transverse direction (Y-axis 105). This movement causes the control system to generate a Y-axis control signal 701, which is inputted into port 705B of switch 705. In the manual mode, the Y-axis control signal 701 is selected as output 779 of port 705A of switch 705 and sent to slope valve 708, which controls the corresponding slope hydraulic cylinder 712 that drives blade 110.

Return to FIG. 7A. The auto/manual switch 402 is then switched to the auto position. The inertial measurement unit IMU 160 (FIG. 1) outputs measured roll angle 770 into buffer 720, which is latched when the operator switches the auto/manual switch 402 from the manual to the auto position. The measured roll angle 770 is constantly updated; the set of measured roll angles is referred to as roll-angle measurements. The value of the roll angle stored in buffer 720 is referred to as buffered roll angle 771, which is inputted into port 728B of program switch 728. The dozer operator, using the user input/output device 304 on console 130 (see FIG. 3), can also enter a value of the roll angle into the user-entry block 725. The value of the roll angle entered into user-entry block 725 is referred to as user-specified roll angle 772, which is inputted into port 728C of program switch 728. Using the console 130, the operator can choose either the buffered roll angle 771 or the user-specified roll angle 772 as the reference roll angle 773, which is outputted to port 728A of program switch 728.

The reference roll angle 773 is inputted into subtracting unit 730. The measured roll angle 770 is inputted into subtracting unit 730, which calculates a difference between the measured roll angle 770 and the reference roll angle 773. The difference 774 is inputted into subtraction unit 740 (see FIG. 7B). Displacement sensors 750 coupled to blade 110 input blade displacement values 780 (also referred to as slope-displacement measurements) into relative blade slope calculation block 745, which calculates estimated relative blade slope value 781 of blade 110 relative to dozer body 102.

Estimated relative blade slope value 781 is inputted to subtraction unit 740, which calculates a difference 777 between the difference 774 and the estimated relative blade slope value 781. The difference 777 is filtered in filter 755. The filtered difference 778 is inputted into port 705C of switch 705. In the automatic mode, the filtered difference 778 is selected as output 779 from output port 705A of switch 705 and sent to slope valve 708.

Figure 8A:
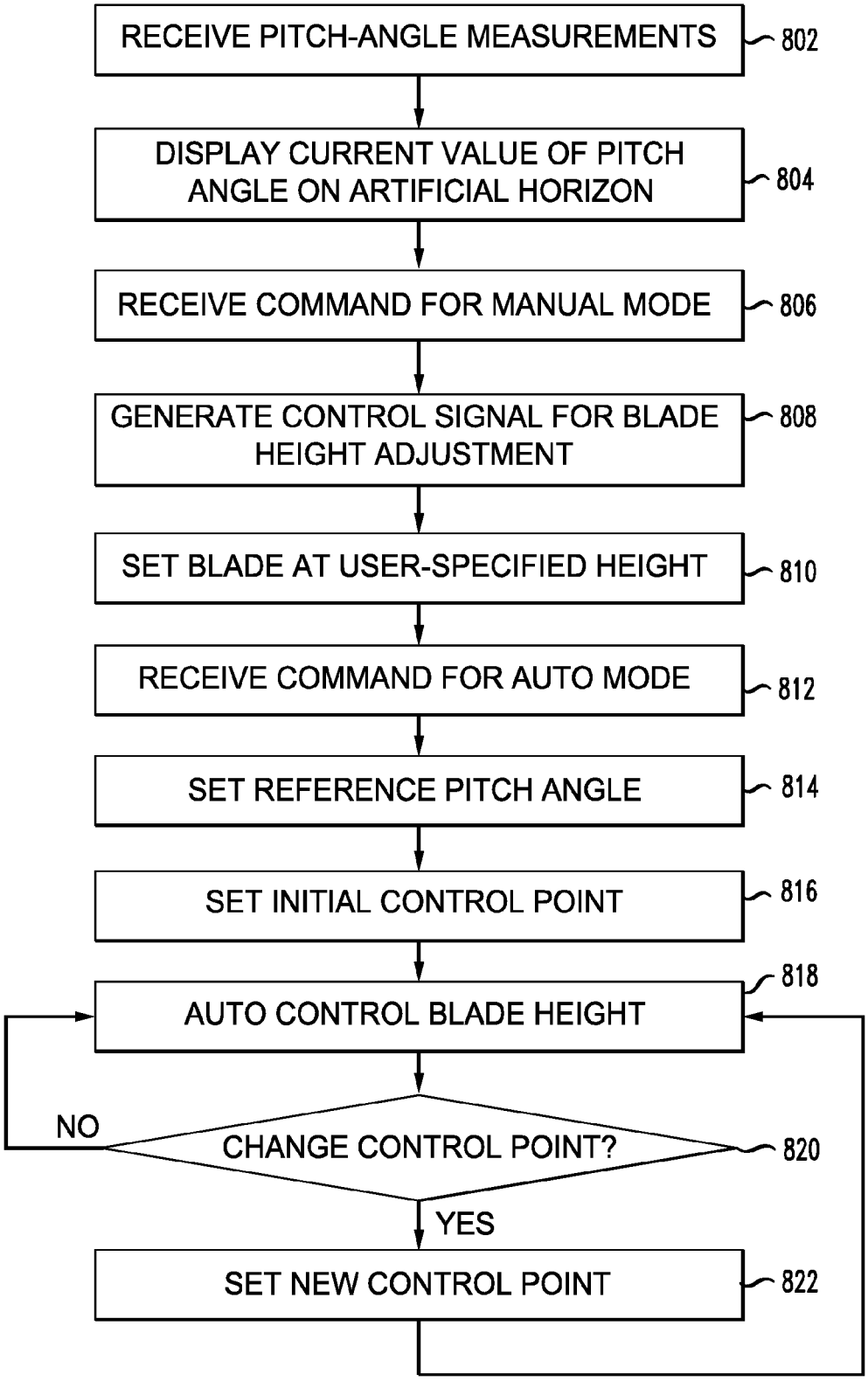
FIG. 8A shows a flowchart of steps for semiautomatic control of blade elevation.

FIG. 8A shows a flowchart of steps performed by a semi-automatic control system for controlling the blade height. In step 802, the control system receives pitch-angle measurements from sensors, such as sensors in inertial measurement unit IMU 160 (FIG. 1). In step 804, the control system displays the current value of the pitch angle on an artificial horizon (FIG. 3), which serves as a visual aid for the dozer operator. In step 806, the control system receives a command to enter a manual operational mode. In an embodiment, a dozer operator issues the command via a switch, such as auto/manual switch 402 (FIG. 4). The process then passes to step 808, in which the control system generates a control signal for blade height adjustment. In an embodiment, the control system generates a user-issued height-control signal in response to operation of a user input device, such as movement (by the dozer operator) of a joystick lever 404 (FIG. 4) along the longitudinal direction. The control signal controls a control valve that operates a pair of hydraulic cylinders 140 (FIG. 1) that controls the height of the blade 110 (FIG. 1). The process then passes to step 810, in which the control system sets the blade at the user-specified height.

The process then passes to step 812, in which the control system receives a command to enter an automatic operational mode. In an embodiment, the dozer operator issues the command via a switch, such as auto/manual switch 402. The process then passes to step 814, in which the control system sets a reference pitch angle. In an embodiment, the control system selects either a buffered pitch angle or a user-specified pitch angle as the reference pitch angle. The selection is made in response to a command issued by the dozer operator via a user input/output device, such as user input/output device 304 in console 130 (FIG. 3). The buffered pitch angle is a measured pitch angle sent, for example, from inertial measurement unit IMU 160 (FIG. 1), and stored in a memory buffer at the instant the control system enters auto mode. The user-specified pitch angle is entered by the dozer operator via a user input/output device, such as user input/output device 304 in console 130.

The process then passes to step 816, in which the control system sets an initial control point. In an embodiment, the control system sets the initial control point to a stored default control point, such as the bottom projection of the center of gravity of the dozer. The process then passes to step 818, in which the control system automatically controls the blade height as the dozer travels. In an embodiment, the control system receives measurements from displacement sensors. Based on the measurements from the displacement sensors, the pitch-angle measurements, the reference pitch angle, and the position of the control point, the control system calculates a control signal according to a user-specified algorithm. The control signal controls the operation of control valves that control the hydraulic cylinders that control the blade height. The control point and the bottom of the blade are maintained on a user-specified profile.

The process then passes to step 820, in which the control system determines whether a command to change the control point has been received. In an embodiment, the dozer operator issues the command via movement of the joystick lever 404 along the longitudinal direction. If a command has not been received, then the control system maintains the initial control point, and the process returns to step 818, in which the control system automatically controls the blade height as the dozer continues to travel.

Refer back to step 820. If a command has been received, then the process passes to step 822, in which the control system sets a new control point in response to movement (by the dozer operator) of the joystick 404. Movement of the joystick results in a user-issued control-point control signal. The process then returns to step 818, in which the control system automatically controls the blade height as the dozer continues to travel. The shifted control point and the bottom of the blade are maintained on a user-specified profile.

Figure 8B:
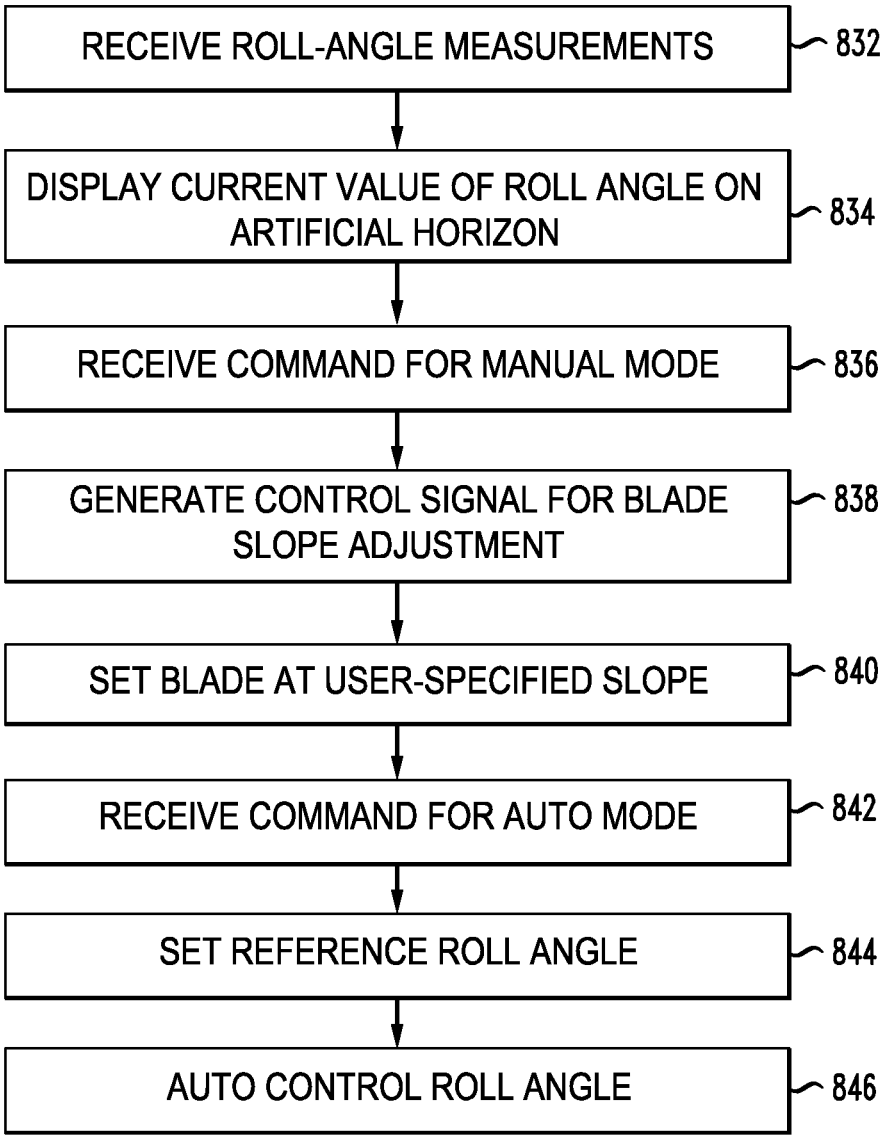
FIG. 8B shows a flowchart of steps for semiautomatic control of blade slope.

FIG. 8B shows a flowchart of steps performed by a semiautomatic control system for controlling the blade slope. In step 832, the control system receives roll-angle measurements from sensors, such as sensors in inertial measurement unit IMU 160. In step 834, the control system displays the current value of the roll angle on an artificial horizon, which serves as a visual aid for the dozer operator. In step 836, the control system receives a command to enter a manual operational mode. In an embodiment, a dozer operator issues the command via a switch, such as auto/manual switch 402. The process then passes to step 838, in which the control system generates a control signal (user-issued slope-control signal) in response to movement (by the dozer operator) of joystick lever 404 along the transverse direction. The control signal controls a control valve that operates a hydraulic cylinder that controls the slope of the blade 110. The process then passes to step 840, in which the control system sets the blade at the user-specified slope.

The process then passes to step 842, in which the control system receives a command to enter an automatic operational mode. In an embodiment, the dozer operator issues the command via a switch, such as auto/manual switch 402. The process then passes to step 844, in which the control system sets a reference roll angle. In an embodiment, the control system selects either a buffered roll angle or a user-specified roll angle as the reference roll angle. The selection is made in response to a command issued by the dozer operator via a user input/output device, such as user input/output device 304 in console 130. The buffered roll angle is a measured roll angle sent, for example, from inertial measurement unit IMU 160, and stored in a memory buffer at the instant the control system enters auto mode. The user-specified roll angle is entered by the dozer operator via a user input/output device, such as user input/output device 304 in console 130.

The process then passes to step 846, in which the control system automatically controls the blade slope as the dozer travels. In an embodiment, the control system receives measurements from displacement sensors. Based on the measurements from the displacement sensors, the roll-angle measurements, and the reference roll angle, the control system calculates a control signal according to a user-specified algorithm. The control signal controls the operation of the control valve that controls the hydraulic cylinder that controls the blade slope.

Figure 9:
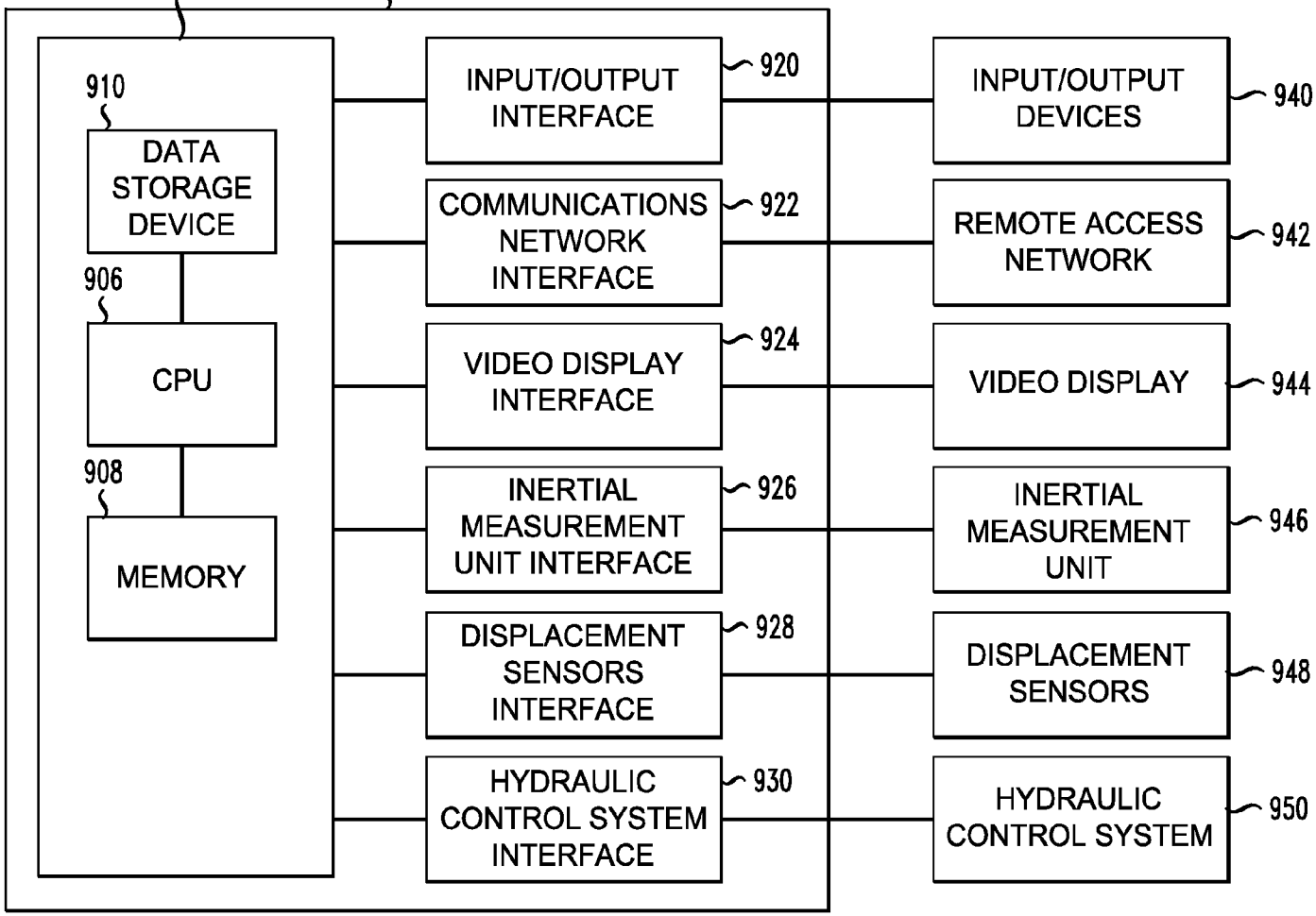
FIG. 9 shows a schematic of a semiautomatic control system.

FIG. 9 shows a schematic of an embodiment of a semiautomatic control system 902 for controlling the height and the slope of a blade on an earthmoving machine. In one configuration, the semiautomatic control system 902 is included as a part of console 130 (FIG. 3); however, it may be a separate unit. One skilled in the art may construct the semiautomatic control system 902 from various combinations of hardware, firmware, and software. One skilled in the art may construct the semiautomatic control system 902 from various electronic components, including one or more general purpose microprocessors, one or more digital signal processors, one or more application-specific integrated circuits (ASICs), and one or more field-programmable gate arrays (FPGAs).

Semiautomatic control system 902 comprises computer 904, which includes a central processing unit (CPU) 906, memory 908, and data storage device 910. Data storage device 910 comprises at least one persistent, tangible computer readable medium, such as non-volatile semiconductor memory, a magnetic hard drive, or a compact disc read only memory. In an embodiment, computer 904 is implemented as an integrated device.

Semiautomatic control system 902 may further comprise user input/output interface 920, which interfaces computer 904 to one or more user input/output device 940. Examples of input/output device 940 include a keyboard, a mouse, a touch screen, a joystick, a switch, and a local access terminal. Data, including computer executable code, may be transferred to and from computer 904 via input/output interface 920. Specific examples of input/output device 940 include user input/output device 304 in FIG. 3 and auto/manual switch 402 and joystick lever 404 in FIG. 4.

Semiautomatic control system 902 may further comprise communications network interface 922, which interfaces computer 904 with remote access network 942. Communications network interface 922 may be wireless. Examples of remote access network 942 include a local area network and a wide area network. A user may access computer 904 via a remote access terminal (not shown) connected to remote access network 942. Data, including computer executable code, may be transferred to and from computer 904 via communications network interface 922.

Semiautomatic control system 902 may further comprise video display interface 924, which interfaces computer 904 to video display 944. A specific example of video display 944 is display 302 in FIG. 3. Semiautomatic control system 902 may further comprise inertial measurement unit interface 926, which interfaces computer 904 to inertial measurement unit 946. Semiautomatic control system 902 may further comprise displacement sensors interface 928, which interfaces computer 904 to displacement sensors 948. Semiautomatic control system 902 may further comprise hydraulic control system interface 930, which interfaces computer 904 to hydraulic control system 950.

As is well known, a computer operates under control of computer software, which defines the overall operation of the computer and applications. CPU 906 controls the overall operation of the computer and applications by executing computer program instructions which define the overall operation and applications. The computer program instructions may be stored in data storage device 910 and loaded into memory 908 when execution of the program instructions is desired. The method steps shown in the flowcharts in FIG. 8A and FIG. 8B, and the processes shown in the schematics of FIG. 6A, FIG. 6B, FIG. 7A, and FIG. 7B, may be defined by computer program instructions stored in the memory 908 or in the data storage device 910 (or in a combination of memory 908 and data storage device 910) and controlled by the CPU 906 executing the computer program instructions. For example, the computer program instructions may be implemented as computer executable code programmed by one skilled in the art to perform algorithms implementing the method steps shown in the flowcharts in FIG. 8A and FIG. 8B and the processes shown in the schematics of FIG. 6A, FIG. 6B, FIG. 7A, and FIG. 7B. Accordingly, by executing the computer program instructions, the CPU 906 executes algorithms implementing the method steps shown in the flowcharts in FIG. 8A and FIG. 8B and the processes shown in the schematics of FIG. 6A, FIG. 6B, FIG. 7A, and FIG. 7B.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A method for semiautomatic control of an earthmoving machine comprising a body having a pitch angle and a roll angle and a blade having a height, a slope, and a bottom edge, wherein a plurality of external forces is applied to the earthmoving machine, the method comprising the steps of:

entering a manual operational mode in response to a first user-issued command;

setting the height of the blade to a user-specified height in response to a user-issued height-control signal;

entering an automatic operational mode in response to a second user-issued command;

receiving a plurality of pitch-angle measurements;

setting a reference pitch angle, wherein the reference pitch angle is a user-desired angle;

setting a control point on a bottom surface of the body, such that an absolute value of a sum of moments of the plurality of external forces about the control point is a minimum; and automatically controlling the height of the blade based at least in part on the control point, the reference pitch angle, and the plurality of pitch-angle measurements.

2. The method of claim 1, wherein the reference pitch angle comprises one of:

a buffered pitch angle; and a user-specified pitch angle.

3. The method of claim 1, wherein the step of automatically controlling the height of the blade based at least in part on the control point, the reference pitch angle, and the plurality of pitch-angle measurements comprises the step of:

automatically maintaining the control point and the bottom edge of the blade on a user-specified profile.

4. The method of claim 1, further comprising the steps of:

receiving a plurality of height-displacement measurements; and automatically controlling the height of the blade based at least in part on the control point, the reference pitch angle, the plurality of pitch-angle measurements, and the plurality of height-displacement measurements.

5. The method of claim 1, further comprising the steps of:

in the manual operational mode:

setting the slope of the blade to a user-specified slope in response to a user-issued slope-control signal; and in the automatic operational mode:

receiving a plurality of roll-angle measurements;

setting a reference roll angle; and automatically controlling the slope of the blade based at least in part on the reference roll angle and the plurality of roll-angle measurements.

6. The method of claim 5, wherein the reference roll angle comprises one of:

a buffered roll angle; and a user-specified roll angle.

7. The method of claim 5, further comprising the steps of:

receiving a plurality of slope-displacement measurements; and automatically controlling the slope of the blade based at least in part on the reference roll angle, the plurality of roll-angle measurements, and the plurality of slope-displacement measurements.

8. The method of claim 5, further comprising the step of:

displaying a value of the pitch angle and a value of the roll angle on an artificial horizon.

9. The method of claim 1, further comprising the steps of:

shifting the control point in response to a user-issued control-point control signal; and automatically controlling the height of the blade based at least in part on the shifted control point, the reference pitch angle, and the plurality of pitch-angle measurements.

10. The method of claim 9, wherein the step of automatically controlling the height of the blade based at least in part on the shifted control point, the reference pitch angle, and the plurality of pitch-angle measurements comprises the step of:

automatically maintaining the shifted control point and the bottom edge of the blade on a user-specified profile.

11. An apparatus for semiautomatic control of an earthmoving machine comprising a body having a pitch angle and a roll angle and a blade having a height, a slope, and a bottom edge, wherein a plurality of external forces is applied to the earthmoving machine, the apparatus comprising:

means for entering a manual operational mode in response to a first user-issued command;

means for setting the height of the blade to a user-specified height in response to a user-issued height-control signal;

means for entering an automatic operational mode in response to a second user-issued command;

means for receiving a plurality of pitch-angle measurements;

means for setting a reference pitch angle, wherein the reference pitch angle is a user-desired angle;

means for setting a control point on a bottom surface of the body, such that an absolute value of a sum of moments of the plurality of external forces about the control point is a minimum; and means for automatically controlling the height of the blade based at least in part on the control point, the reference pitch angle, and the plurality of pitch-angle measurements.

12. The apparatus of claim 11, wherein the reference pitch angle comprises one of:

a buffered pitch angle; and a user-specified pitch angle.

13. The apparatus of claim 11, wherein the means for automatically controlling the height of the blade based at least in part on the control point, the reference pitch angle, and the plurality of pitch-angle measurements comprises:

means for automatically maintaining the control point and the bottom edge of the blade on a user-specified profile.

14. The apparatus of claim 11, further comprising:

means for receiving a plurality of height-displacement measurements; and means for automatically controlling the height of the blade based at least in part on the control point, the reference pitch angle, the plurality of pitch-angle measurements, and the plurality of height-displacement measurements.

15. The apparatus of claim 11, further comprising:

means for displaying a value of the pitch angle and a value of the roll angle on an artificial horizon.

16. The apparatus of claim 11, further comprising:

in the manual operational mode:

means for setting the slope of the blade to a user-specified slope in response to a user-issued slope-control signal; and in the automatic operational mode:

means for receiving a plurality of roll-angle measurements;

means for setting a reference roll angle; and means for automatically controlling the slope of the blade based at least in part on the reference roll angle and the plurality of roll-angle measurements.

17. The apparatus of claim 16, wherein the reference roll angle comprises one of:

a buffered roll angle; and a user-specified roll angle.

18. The apparatus of claim 16, further comprising:

means for receiving a plurality of slope-displacement measurements; and means for automatically controlling the slope of the blade based at least in part on the reference roll angle, the plurality of roll-angle measurements, and the plurality of slope-displacement measurements.

19. The apparatus of claim 11, further comprising:

means for shifting the control point in response to a user-issued control-point control signal; and means for automatically controlling the height of the blade based at least in part on the shifted control point, the reference pitch angle, and the plurality of pitch-angle measurements.

20. The apparatus of claim 19, wherein the means for automatically controlling the height of the blade based at least in part on the shifted control point, the reference pitch angle, and the plurality of pitch-angle measurements comprises:

means for automatically maintaining the shifted control point and the bottom edge of the blade on a user-specified profile.

* * * * *